US005377984A

United States Patent [19]

Ciccia

[11] Patent Number: 5,377,984

[45] Date of Patent: Jan. 3, 1995

[54] UNIVERSAL HAND GRIP DEVICE

[76] Inventor: Samuel J. Ciccia, 375 Grant St., Buffalo, N.Y. 14213

[21] Appl. No.: 193,575

[22] Filed: Feb. 8, 1994

[51] Int. Cl.[6] ..... A63B 53/14

[52] U.S. Cl. ..... 273/165; 273/81.4; 273/81.3

[58] Field of Search ..... 273/165, 81 D, 81.3, 273/187.5, 81.4

[56] References Cited

U.S. PATENT DOCUMENTS 3,245,686 4/1966 Hartmeister ..... 273/81.3

3,533,630 10/1970 Monaco ..... 273/165

3,680,870 8/1972 Burnett et al. ..... 273/194 B

*Primary Examiner*—George J. Marlo

*Attorney, Agent, or Firm*—James J. Ralabate

[57] ABSTRACT

This invention provides a universal golf club grip to be used by either a right or left handed golfer. A right handed golfer would use the grip with his or her left hand and visa versa for a left handed golfer. The grip provides for an accurate approach and contact with a golf ball for better distance and control. The grip is easily removably but will lock securely in place when pushed up a golf club handle. It is comfortable and efficient to use and should substantially improve the elements of a golfer's game.

18 Claims, 2 Drawing Sheets

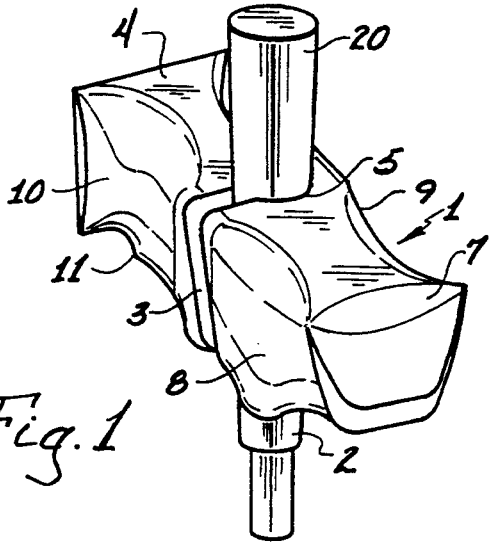
Fig. 1
Fig. 2
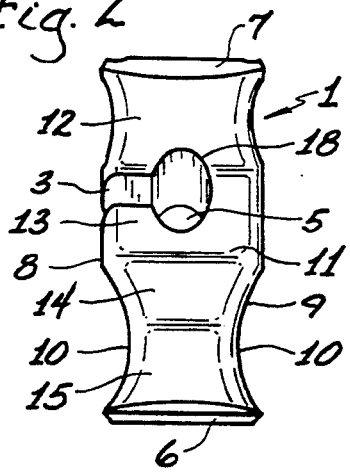
Fig. 3
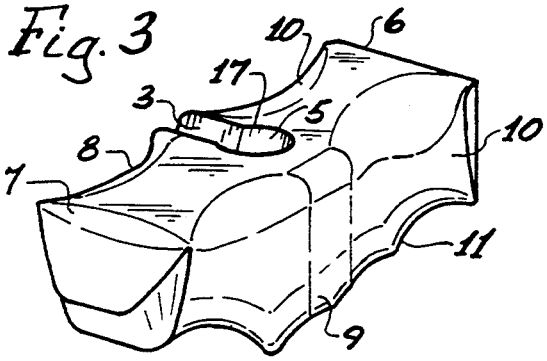
Fig. 4
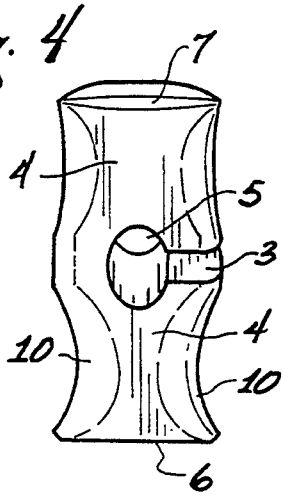
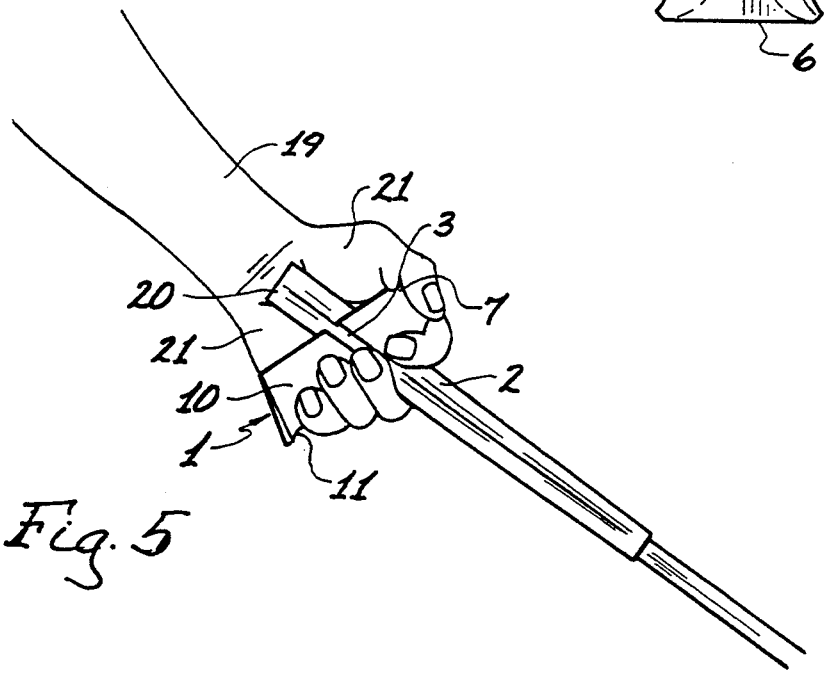
Fig. 5

UNIVERSAL HAND GRIP DEVICE

This invention relates to a grip device for a golf club and, more particularly, to a novel removable device that can be used by both left and right handed players.

BACKGROUND OF THE INVENTION

There are known several devices for use in gripping a golf club. Most of these attachments are used one way or the other to improve the golfer's game and, in most instances, to improve his or her accuracy in holding the club. Some attachments have been proposed that allegedly permit greater driving power or resulting greater distances. Typical of these devices are those disclosed in U.S. Pat. Nos. 1,855,126; 2,710,190; 2,962,288 and 3,533,630.

In U.S. Pat. No. 1,855,126 (Connell) an attachment for golf clubs is disclosed which is provided with screw holes through which screws or rivets firmly attach it to the handle of a golf club. The Connell device fits and extends substantially tangential to the handle and encircles or extends spirally around the club handle. The use of screws to attach Connell's grip device to a club handle either requires permanent attachment or results in unsightly screw holes when the grip is removed and not used. Also, the Connell device is for a right hand grip making no provision for the left hand placement. The drawings of Connell (FIG. 1) and his disclosure column 1 lines 13–16 make it clear that his device is for right hand grips only.

Throughout the present disclosure in the single use (non universal) embodiment reference will be made to right and left hand grips for illustration purposes. These references will be drawn to a right handed player. Obviously, for left handed players just the reverse is true. Thus, while the present hand grip is for the left hand and is described as such, a left handed person would use it with his or her right hand.

In the preferred universal grip embodiment of this invention provision is made for use by both or either right or left handed players. This is accomplished by placing finger and palm guide impressions on both sides of the gripping device.

In U.S. Pat. No. 2,710,190 (Schimansky) a hand grip attachment for golf clubs is described where the attachment is placed tangential to the axis of the club. Schimansky's device is adapted to be permanently secured to the handle or it may be detachably connected to a club. His device is used to properly position the lower hand (right hand) upon the handle of the club and to give the thumb and forefinger a better grip on the handle. An aperture is positioned in his device to receive the index finger of the user and allows the other three fingers to be gripped around the handle of the club. The longitudinal axis of Schimansky's device as with Connell's device is parallel to the longitudinal axis of the golf club. Also, Schimansky's device is only suitable for use with the right hand and no provision is made for left handed users or use with the left hand of right handed players. Schimansky's device is provided with a clamping ring with tightening screws for securing the grip device to the handle. Thus, after his device is fitted around the club and pushed into position, it is tightened by turning screw 20 as shown in his FIG. 3. His grip is a two-piece structure each of which must be attached to a club handle.

In U.S. Pat. No. 2,962,288 (Lowden) a golf putter grip device is disclosed for use primarily when the golfer is putting. His device is used as a grip for the right hand while leaving the left hand free for guiding the golf club. The purpose of Lowden's device is to provide more power for the right hand of right handed golfers.

LoMonaco in U.S. Pat. No. 3,533,630 discloses a four-piece golf club grip device. A clamping device is used to attach the LoMonaco grip to a golf club handle. A set screw 4 in LoMonaco is tightened or releases to attach the grip (or remove) it from the golf club handle. Since the handle grip on LoMonaco's device is the clamping device, holding his handle grip with the left hand only on the follow through will change the tension on the clamping device possibly releasing the grip from the club handle.

SUMMARY OF THE INVENTION

It is therefore an object of this invention to provide a golf club gripping device devoid of the above-noted disadvantages. A primary object is to provide a grip for golf clubs which will enable the player to hold the club more firmly so that the head of the club is always held correctly in position for the stroke and so that at the time of impact with the ball the head of the club cannot turn sideways and foul the stroke and drive the ball incorrectly, but will keep its correct position and communicate the full energy of the stroke to the ball, thus securing accurate driving for the longest possible shot.

Another object of this invention is to provide a golf grip attachment that can be used by both right and left handed players.

A further object of this invention is to provide a grip device that is used with the left hand and improves the control and stability of gripping a golf club.

Still a further object of this invention is to provide a means for a firmer and a more natural grip for the left hand and to emphasize the unrestricted power swing of the left arm while permitting release of the right hand.

Another still further object of this invention is to provide a self-locking gripping device that will be easily fitted onto and be firmly positioned on a golf club handle.

Yet another object of this invention is to provide a device that will correct the incorrect left hand gripping of a golf club.

Still another object of this invention is to provide a gripping device that will substantially improve a golfer's game at a relatively minimum cost.

Yet still a further object of this invention is to provide a hand grip attachment for golf clubs that will substantially prevent the left hand from turning or slipping on the club.

Yet another still further object of this invention is to provide a golf club grip device that will hold the club more firmly so as to correctly position the head of the club.

Another object of this invention is to provide a gripping device that will correctly position the user's stroke so that at the time of ball impact the head of the club imparts substantially the full energy to the ball.

These and other objects of this invention are accomplished by a novel hand grip attachment for golf clubs that can be used by both left and right handed players. A right handed player will use the grip with his left hand and visa versa for a left handed player. The universal grip of this invention has a substantially flat top portion curved slightly at the top front to accommodate a thumb that will extend over the front corner down the top front of the grip. A slanted conduit into which the club handle fits extends through the entire height of the grip, the bore-like conduit is tapered downwardly so that it has a smaller diameter at its lower terminal portion and a larger diameter at its upper terminal portion. A slot is located and opens into the conduit so that the grip can slide onto the golf club handle at its thinnest part and is moved upwardly to the thicker part of the handle where it will firmly lock in place. Each side portion of the grip is conformed to fit or cradle the palm for either the right or left hand. The grip sides fishtail at their rear section to receive the palm in its palm engaging surface. Both sides of the grip are substantially identical. At the bottom surface of the grip are grooves which extend through the grip width to accommodate the user's fingers, the groove for the forefinger is forward of the conduit terminus, the groove for the middle finger is over the conduit terminus, the groove for the ring finger is behind the conduit terminus and the small finger groove is behind the ring finger groove. The club handle thus will extend between the forefinger and the middle finger of the user. Placing the thumb and four fingers in the correct locations on the grip will ensure that the club and its head is always correct and in maximum position for head contact with the ball. The head cannot turn out of its desired position if the grip is properly held. While it is preferred that the grip be universal a one-sided grip for right or left hand use is within the scope of the invention- Since the conduit is tunneled through the entire height of the grip at an angle and tapered so that the bottom terminal portion is smaller than the top terminal portion, the grip will always lock ih the correct position on the club. The conduit angles forward as it extends from the top to the bottom (as shown in the drawings). When in the lock position, the grip of this invention is at an oblique angle relative to the longitudinal axis of the club. When in the correct position, the club will extend upwardly beyond the grip to fit snugly in the center of the heels of the palm. Therefore, the angle of the conduit is located and slanted so that the upper part of the golf club rests easily between the two palm cheeks or heels. In golfing, contrary to baseball and other sports, the normal strength hand is used as the guiding hand and the other hand is used for exerting the power during the drive. For example, a right handed person, when using a golf club, relies upon his left hand for the power exerted during the drive and the right hand to guide the golf club in its arc. This, of course, is contrary to the normal reactions of a person.

BRIEF DESCRIPTION OF THE DRAWINGS

FIG. 1 is a side perspective view of the universal grip of this invention in a locked position on a golf club.

FIG. 2 is a bottom perspective view of the universal grip with finger grooves or guides extending across the grip bottom portion.

FIG. 3 is a front perspective view of the present universal grip illustrating the front thumb rest section extending from the top portion to the front portion of the grip.

FIG. 4 is a top perspective view showing the substantially flat top portion of the universal grip.

FIG. 5 is a side perspective view showing the position of the universal grip when locked in place and used with the left hand of a right handed golfer.

DESCRIPTION OF THE DRAWING AND PREFERRED EMBODIMENT

Figure 6:
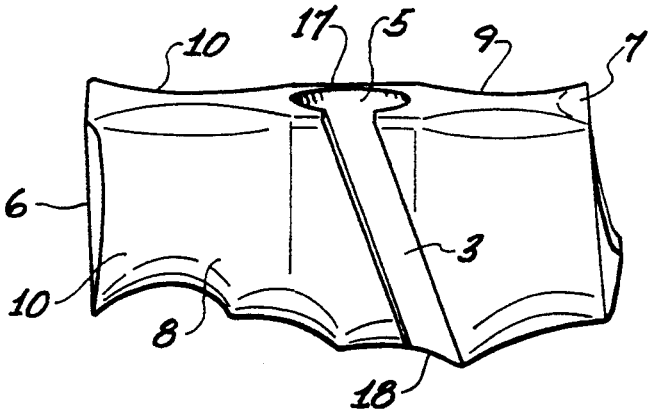
FIG. 6 is a side perspective of the grip showing the top to bottom angled conduit.

In FIG. 1 the universal grip 1 of this invention is shown in its locked position on a golf club handle 2. The slot 3 in the grip 1 is large enough to fit over the narrowest part of handle 2 at the bottom of the club. Once the handle 2 is fit into the conduit 5 of grip 1 via slot 3, the grip 1 is pushed upward until it reaches the wider part 20 of handle 2 where it locks into position on the handle 2. The conduit 5 is tapered so that its upper diameter is larger than its lower diameter thus accommodating locking of grip 1 securely in position. No screws or other attachment means are required. While this grip 1 is removable it can be used permanently on the golf club handle if desired. The front-top corner 7 of grip 1 is rounded to permit the placement of the thumb (as shown in FIG. 5). Obviously, slot 3 is only large enough to slip over the narrow club portion before the grip 1 is pushed up to lock in position. Both side sections 8 and 9 are shaped to accommodate the palm of either a right or left hand, thus the grip i is universal in that either a right handed or left handed person may use it. The rear of the sides fishtail outwardly at 10 to allow the palm heel to fit comfortably therein. The upper or top side 4 of grip 1 is substantially flat but the bottom portion 11 has four finger guides or grooves 12, 13, 14 and 15 to permit easy gripping by the four fingers. The forefinger groove is shown at 12, the middle finger groove at 13, the ring finger groove at 14 and the small or pinky finger groove is at 15. The "top" and "bottom" sides or portions refer to those portions when the grip 1 is locked in position on the club. Thus, in FIG. 1, the top portion 4 is uppermost on the club. FIG. 2 shows the bottom side. The finger positioning can be clearly seen in FIG. 5. In FIG. 3 a front top perspective view of substantially rectangular grip 1 is illustrated. The rounded top-front corner 7 is indicated extending down a substantial portion of the front side 16. The diameter of the conduit top opening 17 is wider than the diameter of conduit bottom opening 18 (of FIG. 2). This is to facilitate the locking feature of grip 1. The top side portion 4 is shown as substantially flat but it may take on any suitable form since it is not as critical to the hand placement as arc front thumb section 7, sides 8 and 9 and bottom finger section 11. In FIG. 4 the top section 4 is shown in perspective with conduit 5 diminishing in size as it extends from top section 4 to bottom section 11. The curved top-front corner 7 can also be clearly seen in this figure.

In FIG. 5 (a right handed user) placement of the left hand 19 on the grip 1 of this invention is illustrated. The thumb fits over the top-front corner 7 with the fingers placed properly in slots or finger grooves 12, 13, 14 and 15 (of FIG. 2). By proper positioning of the hand on grip 1, the extending section of the golf club 20 fits squarely between the two heels of the palm 21. It is critical to this invention that:

A. the front-top corner 7 be curved for the thumb placement;

B. the conduit 5 be tapered from top to bottom;

C. both sides 8 and 9 have palm-fitting curvatures to be a universal grip;

D. the conduit 5 be at an angle (as shown in FIG. 6); and

Figure 7:
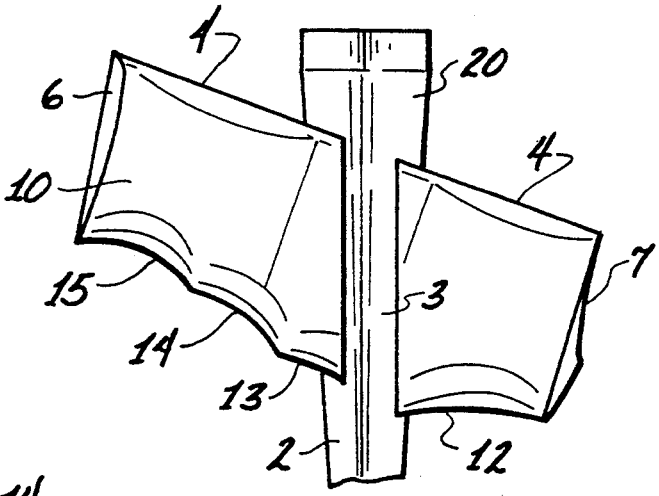
FIG. 7 is a side perspective view of the universal grip in a locked position on the club handle.

E. the grip 1 fit on the golf club at an oblique angle (as shown in FIGS. 1, 5 and 7).

Figure 8:
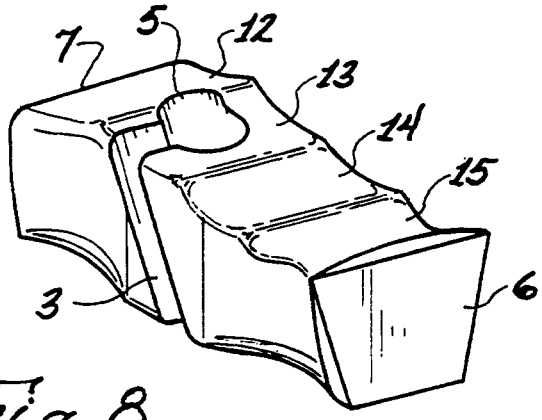
FIG. 8 is a rear perspective view of the universal grip showing the substantially flat surface of the rear side.
Figure 9:
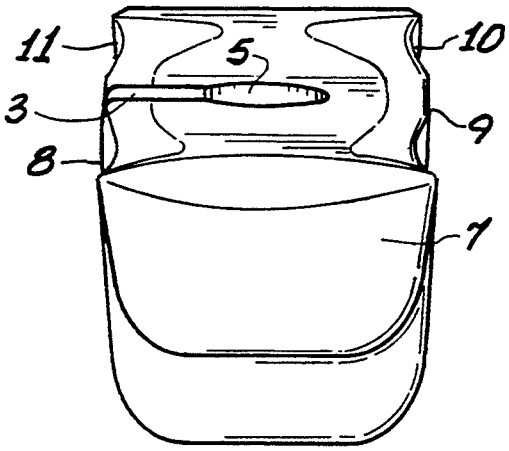
FIG. 9 is a front top perspective showing the thumb rest section over the corner of the top and front portion of the grip.

It is also important to this invention that an appropriate slot 3 be provided to slide the grip 1 on the club handle 2. The slot 3 is of substantially equal dimensions from top to bottom and is tangential to the longitudinal axis of conduit 5 and club handle 2. The slot 3 and conduit 5 are positioned at a top to bottom angle horizontal or bottom 11 of grip 1. The correct angle of the fixed grip provides from the club portion 20, an acute angle from the club to the rear section and forward from the club handle 20 an obtuse angle as shown in FIGS. 5 and 7. The larger conduit upper terminal opening 17 again is larger than bottom conduit opening 18. The back section 6 of grip 1 can be flat or any other suitable configuration as shown in FIGS. 2, 6 and 7. The club handle 2 and 20 fits between the index finger and middle finger as shown in FIG. 5 and between grooves 12 and 13 as shown in FIG. 7. In FIG. 8 the flat back portion 6 is shown but, as noted earlier, sides 6 and 4 can be of any suitable configuration. While the form of top and back sides 4 and 6 are not critical, the configuration of the corner of top side 4 and front side 16 is important to thumb placement. The critical configurations are sides 8 and 9 and bottom portion 11 in addition to conduit 5. In FIG. 8 the grip 1 is resting on its top portion 4 with bottom grooved portion 11 facing up for clarity and clearer illustration of the grooves 12, 13, 14 and 15. In FIG. 9 a top front perspective of grip 1 is shown having beveled top-front corner 7 for thumb placement. Note that for thumb and finger placement, as noted several times earlier, either hand may be used. This feature is missing from the prior art. Therefore, not only can the universal grip of this invention be used for training someone in golf, it more importantly can be a grip that is used permanently for all appropriate golf games which should significantly improve one's score, distance and accuracy.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A universal golf club grip comprising a substantially rectangular unit having a front, back, top, bottom and two side portions, said grip having a slotted conduit extending through its entire height and originating from a top substantially central section of said top portion and terminating at said bottom portion, said conduit tapered from a larger top terminal opening to a smaller bottom terminal opening, said two side portions being configured to receive the palm of either a right or left hand, said bottom portion having finger grooves to receive the fingers of either a right or left hand.

2. The grip of claim 1 wherein a top front corner of said substantially rectangular unit is beveled to permit a left or right hand thumb to be placed thereover.

3. The grip of claim 1 wherein said conduit extends at an angle through the height of said grip, said larger top terminal opening being closer to said back portion than said smaller bottom terminal opening.

4. The grip of claim 1 wherein said bottom portion has four slots or grooves to receive the fingers of a right or left hand.

5. The grip of claim 1 wherein said back and said top portions are substantially flat.

6. The grip of claim 1 wherein said two side portions have sections adjacent said conduit that are substantially tangential to the curvature of a portion of said conduit, said sections conformed to receive the palm of a right or left hand.

7. The grip of claim 1 wherein said two side portions have back terminal sections that fishtail outwardly as they approach said back portion.

8. The grip of claim 1 wherein said conduit smaller bottom terminal opening is located substantially between a forefinger and a middle finger groove.

9. The grip of claim 1 wherein said slotted conduit provides a slot opening sufficient to fit over a thin bottom portion of a golf club.

10. A universal golf club grip adapted to fit obliquely onto a top section of a golf club handle, said grip having a substantially rectangular configuration with a front portion, a back portion, a top portion, a bottom portion and two side portions, said two side portions being substantially identical in configuration thereby providing means for a palm of a user to fit a right hand on one side and a left hand on an opposite side, one of said side portions having a slot that extends throughout its entire height, said slot opening into a tapered conduit which is coextensive with said slot, said conduit tapered from a larger top terminal opening to a smaller bottom terminal opening, said bottom portion having finger grooves to receive the fingers of either a right or left hand.

11. The grip of claim 10 wherein a top front corner of said substantially rectangular unit is beveled to permit a left or right hand thumb to be placed thereover.

12. The grip of claim 10 wherein said conduit extends at an angle through the height of said grip, said larger top terminal opening being closer to said back portion than said smaller bottom terminal opening.

13. The grip of claim 10 wherein said bottom portion has four slots or grooves to receive the fingers of a right or left hand.

14. The grip of claim 10 wherein said back and said top portions are substantially flat.

15. The grip of claim 10 wherein said two side portions have sections adjacent said conduit that are substantially tangential to the curvature of a portion of said conduit, said sections conformed to receive the palm of a right or left hand.

16. The grip of claim 10 wherein said two side portions have back terminal sections that fishtail outwardly as they approach said back portion.

17. The grip of claim 10 wherein said conduit smaller bottom terminal opening is located substantially between a forefinger and a middle finger groove.

18. The grip of claim 10 wherein said slotted conduit provides a slot opening sufficient to fit over a thin bottom portion of a golf club.

* * * * *